US006364720B1

(12) United States Patent
Liang

(10) Patent No.: US 6,364,720 B1
(45) Date of Patent: Apr. 2, 2002

(54) BATTERY TERMINAL CONNECTOR

(76) Inventor: Shih-Tsung Liang, No. 10, Lane 31, Ta-Feng St., Neitsou Tsun, Lu-Chu Hsiang, Taoyuan County (TW)

( * ) Notice: Subject to any disclaimer, the term of this patent is extended or adjusted under 35 U.S.C. 154(b) by 0 days.

(21) Appl. No.: 09/737,575

(22) Filed: Dec. 18, 2000

(51) Int. Cl.[7] ..... H01R 4/42
(52) U.S. Cl. ..... 439/764; 439/462
(58) Field of Search ..... 439/761–764, 439/461, 462, 202, 203, 504, 522

(56) References Cited

U.S. PATENT DOCUMENTS

| | | | | | |
|---|---|---|---|---|---|
| 5,171,169 | A | * | 12/1992 | Butcher et al. | 439/755 |
| 5,190,485 | A | * | 3/1993 | Ransdell | 439/798 |
| 5,573,423 | A | * | 11/1996 | Lin et al. | 439/462 |
| 5,707,258 | A | * | 1/1998 | Pilotti | 439/763 |
| 5,877,609 | A | * | 3/1999 | Carter | 320/103 |
| D438,173 | S | * | 2/2001 | Liang | D13/120 |

FOREIGN PATENT DOCUMENTS

| | | | | |
|---|---|---|---|---|
| JP | 54007590 | * | 1/1979 | 439/805 |

* cited by examiner

*Primary Examiner*—Gary Paumen
*Assistant Examiner*—James R. Harvey
(74) *Attorney, Agent, or Firm*—Rosenberg, Klein & Lee

(57) ABSTRACT

A battery terminal connector includes a metal mounting base and a number of metal wire distribution holders radially extended from the periphery of the mounting base, the mounting base having a first clamping arm and a second clamping arm arranged in parallel and defining a circular mounting hole and a narrow gap in communication with the circular mounting hole for mounting on a terminal of a battery, the first clamping arm having a transverse screw hole disposed on a front extension portion thereof, the second clamping arm having a transverse through hole disposed on a front extension portion thereof and connected to the transverse screw hole of the first clamping arm by a screw bolt after coupling of the circular mounting hole to the terminal of the battery, the wire distribution holders each having one or more screw holes for the mounting of a respective screw bolt to secure a respective electric wire.

4 Claims, 7 Drawing Sheets

BATTERY TERMINAL CONNECTOR

BACKGROUND OF THE INVENTION

The present invention relates to a battery terminal connector adapted to connect electric wires to a terminal of a battery and, more particularly, to a simple structure of battery terminal, which is inexpensive to manufacture and, can positively be secured to the terminal of the battery.

FIGS. 12 and 13 show a battery terminal connector according to the prior art. This structure of battery terminal connector comprises a wire distribution part 5 adapted to receive electric wires 2, and two clamping arms 51 adapted for fastening to a battery terminal 31. The wire distribution part 5 has a plurality of screw holes at the top for the mounting of screws 61 to secure respective electric wires 2. The clamping arms 51 each have an arched rear portion respectively extended from the wire distribution part 5, and a free end terminating in an extension portion 52. The arched rear portions of the clamping arms 31 define a split mounting hole 511 adapted to receive the battery terminal 31. After attaching the split mounting hole 511 to the battery terminal 31, a screw bolt 53 is fastened to the extension portions 52 of the clamping arms 51 to secure the clamping arms 51 to the battery terminal 31. The typical battery terminal connector has numerous drawbacks as outlined hereinafter.

1. Because the arched rear portions of the clamping arms are connected to each other and formed integral with the solid wire distribution part, the clamping arms have less resilience and a gap may be left between the clamping arms and the battery terminal after installation of the battery terminal connector (see FIG. 13). In order to eliminate this problem, the processing precision is critical, and the strict precision requirement greatly increases the manufacturing cost of the battery terminal connector.
2. Because the clamping arms have less resilience, much effort should be employed when fastening the clamping arms to the battery terminal.
3. During installation, it is complicated to fasten up the screw bolt. If the screw bolt is not tightly fastened up, the battery terminal connector may be forced out of position.
4. When fastening up the screw bolt with force to overcome the spring force of the clamping arms, the threads of the screw bolt may be damaged.
5. In order to receive a large number of electric wires, the volume or the area of the wire distribution part must be made relatively greater for processing a large number of screw holes, in this case, the material cost will be relatively increased.
6. Because multiple screw holes are arranged in the limited space of the wire distribution part, it is difficult to install a large number of electric wires in the narrow area of the wire distribution part.

SUMMARY OF THE INVENTION

The present invention has been accomplished to provide a battery terminal connector, which eliminates the aforesaid drawbacks. It is one object of the present invention to provide a battery terminal connector, which is inexpensive to manufacture. It is another object of the present invention to provide a battery terminal connector, which achieves high performance in the transmission of battery power. According to one aspect of the present invention, the battery terminal connector comprises a metal mounting base and a plurality of metal wire distribution holders integral with the periphery of the mounting base. The mounting base comprises a first clamping arm and a second clamping arm arranged in parallel and defining a circular mounting hole and a narrow gap in communication with the circular mounting hole for mounting on a terminal of a battery. The first clamping arm has a transverse screw hole disposed on a front extension portion thereof. The second clamping arm has a transverse through hole disposed on a front extension portion thereof and connected to the transverse screw hole of the first clamping arm by a screw bolt after coupling of the circular mounting hole to the terminal of the battery. The wire distribution holders each has at least one screw hole for the mounting of a respective screw bolt to secure a respective electric wire. According to another aspect of the present invention, the wire distribution holders are radially extended from the periphery of the mounting base, so that much operation space is provided for enabling the user to install electric wires conveniently.

DETAILED DESCRIPTION OF THE PREFERRED EMBODIMENT

Figure 1:
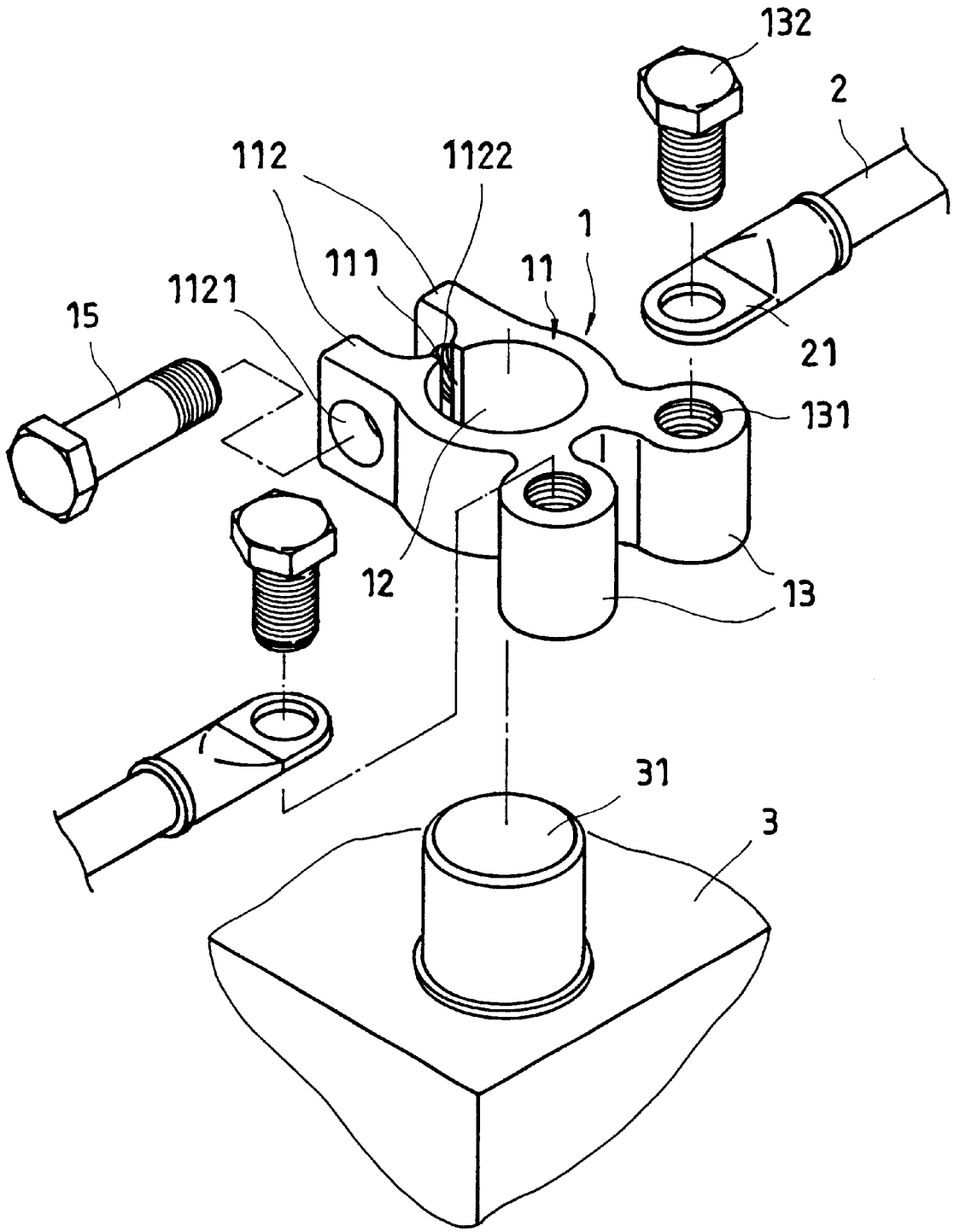
FIG. 1 illustrates a battery terminal connector according to one embodiment of the present invention.
Figure 2:
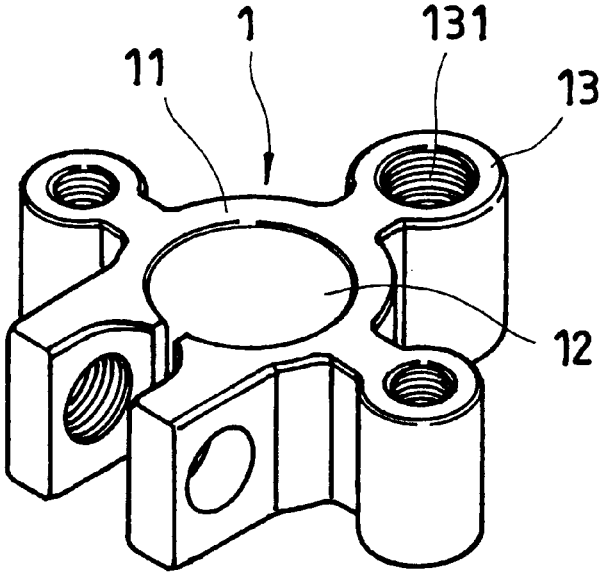
FIG. 2 is an elevational view of an alternate form of the battery terminal connector according to the present invention.
Figure 3:
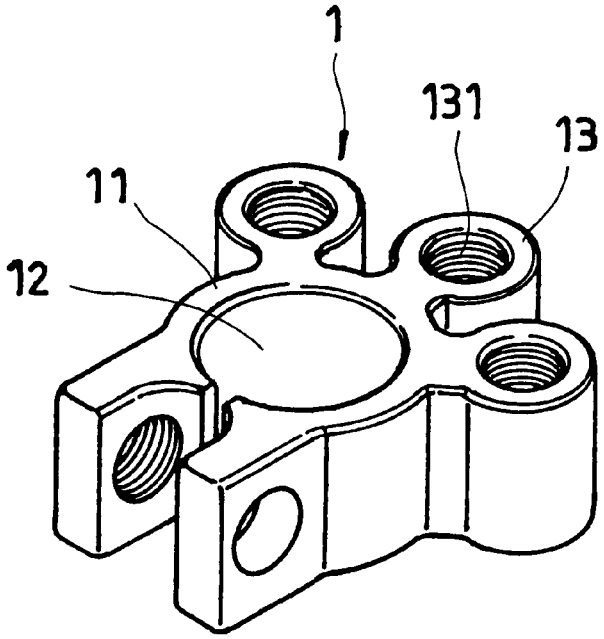
FIG. 3 is an elevational view of another alternate form of the battery terminal connector according to the present invention.
Figure 4:
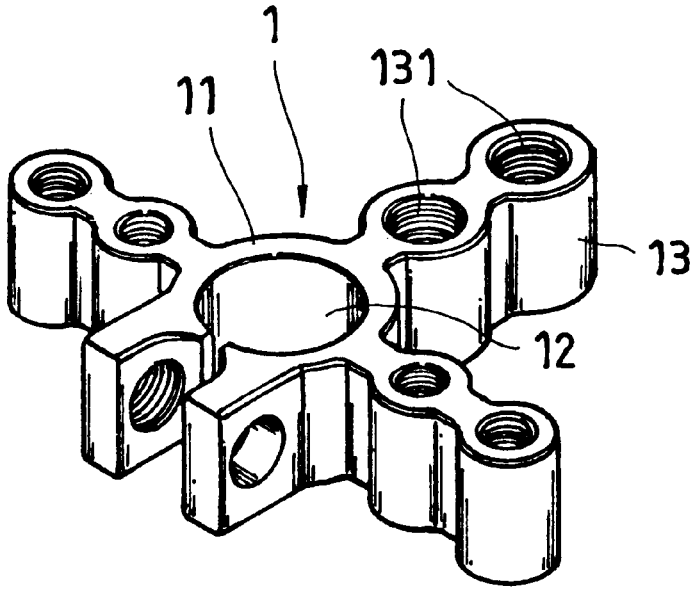
FIG. 4 is an elevational view of still another alternate form of the battery terminal connector according to the present invention.
Figure 5:
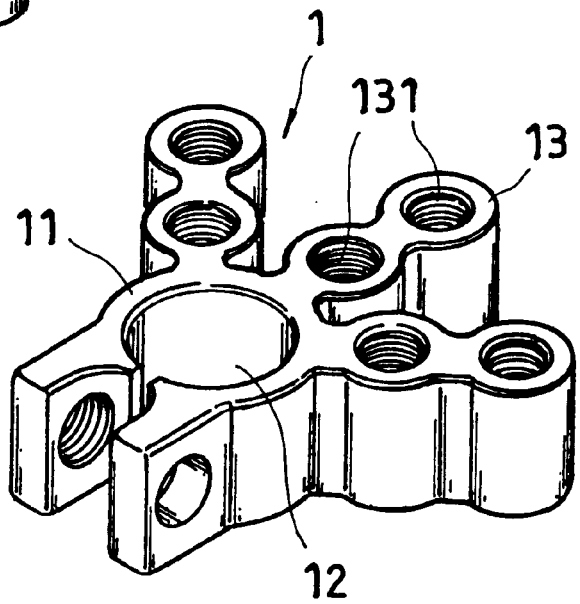
FIG. 5 is an elevational view of still another alternate form of the battery terminal connector according to the present invention.
Figure 6:
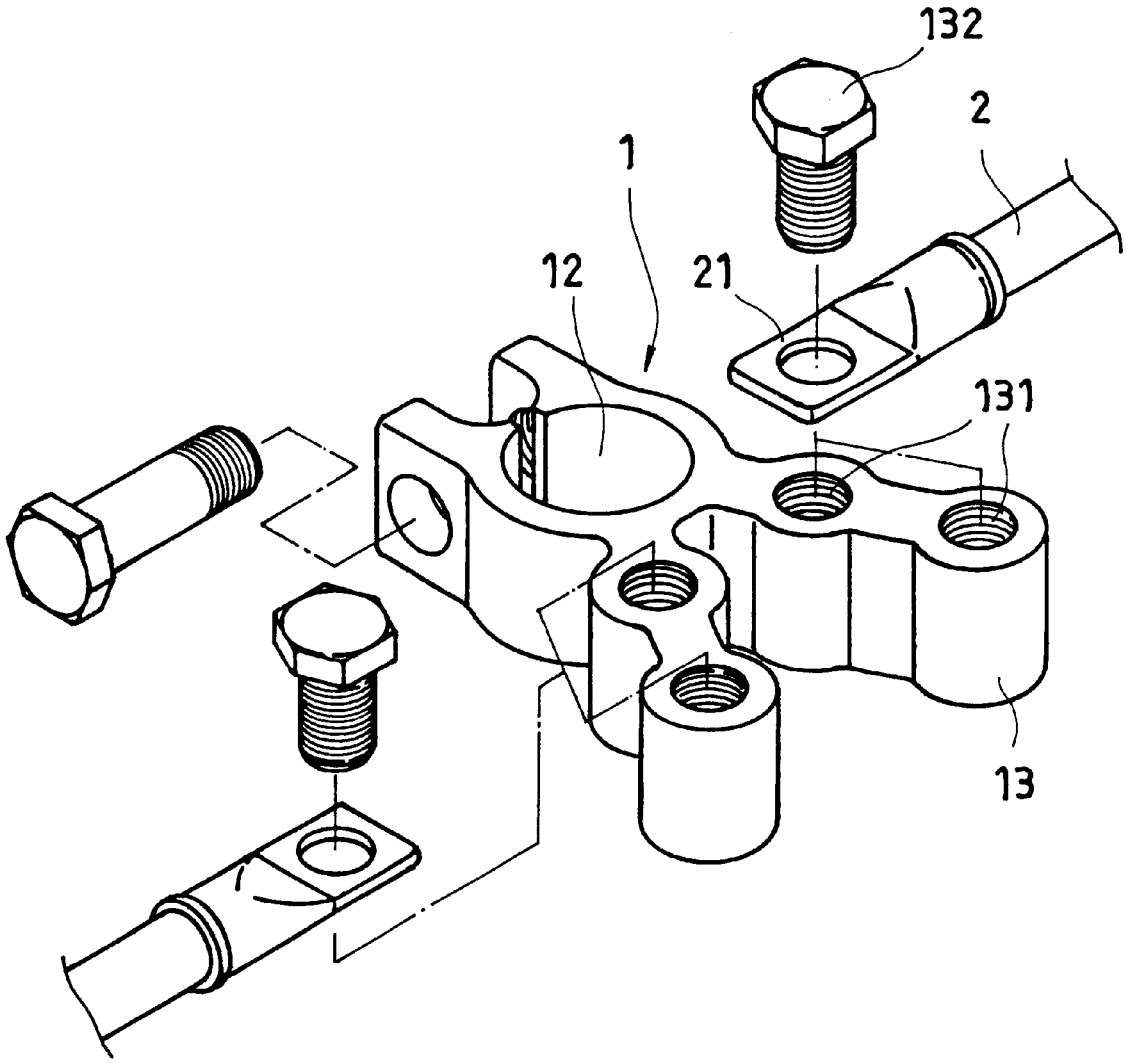
FIG. 6 illustrates still another alternate form of the battery terminal connector according to the present invention.

Referring to FIG. 1, a battery terminal connector 1 is shown and comprises a metal mounting base 11, and a plurality of metal wire distribution holders 13 integral with the mounting base 11. The mounting base 11 comprises two clamping arms 111 arranged in parallel. The clamping arms 111 define a circular mounting hole 12 and a narrow gap in communication with the circular mounting hole 12, each having a front extension portion 112. A through hole 1121 is made through the front extension portion 112 of one clamping arm 111, and a screw hole 1122 is made through the front extension portion 112 of the other clamping arm 111. When in use, the circular mounting hole 12 is coupled to the terminal 31 of the battery 3, and then a screw bolt 15 is inserted into the through hole 1121 and threaded into the screw hole 1122 to secure the clamping arms 111 firmly to the terminal 31 of the battery 3. The aforesaid wire distribution holders 13 are radially extended from the periphery of the metal mounting base 11, each having a screw hole 131 into which a screw bolt 132 is threaded to secure the terminal 21 of a respective electric wire 2 in position. The number of the wire distribution holders 13 can be changed subject to actual requirement. For example, in the embodiment shown in FIG. 1, the battery terminal connector 1 comprises two metal wire distribution holders 13. In the embodiment shown in FIG. 2 and the embodiment shown in FIG. 3, the number of the wire distribution holders 13 is three. Further in FIG. 1, each wire distribution holder 13 comprises one screw hole 131 adapted to receive one screw bolt 132 and one electric wire 2. In the embodiments shown in FIGS. 4, 5 and 6, each wire distribution holder 13 comprises two screw holes 131 arranged in parallel for receiving two screw bolts 132 and two electric wires 2.

Figure 7:
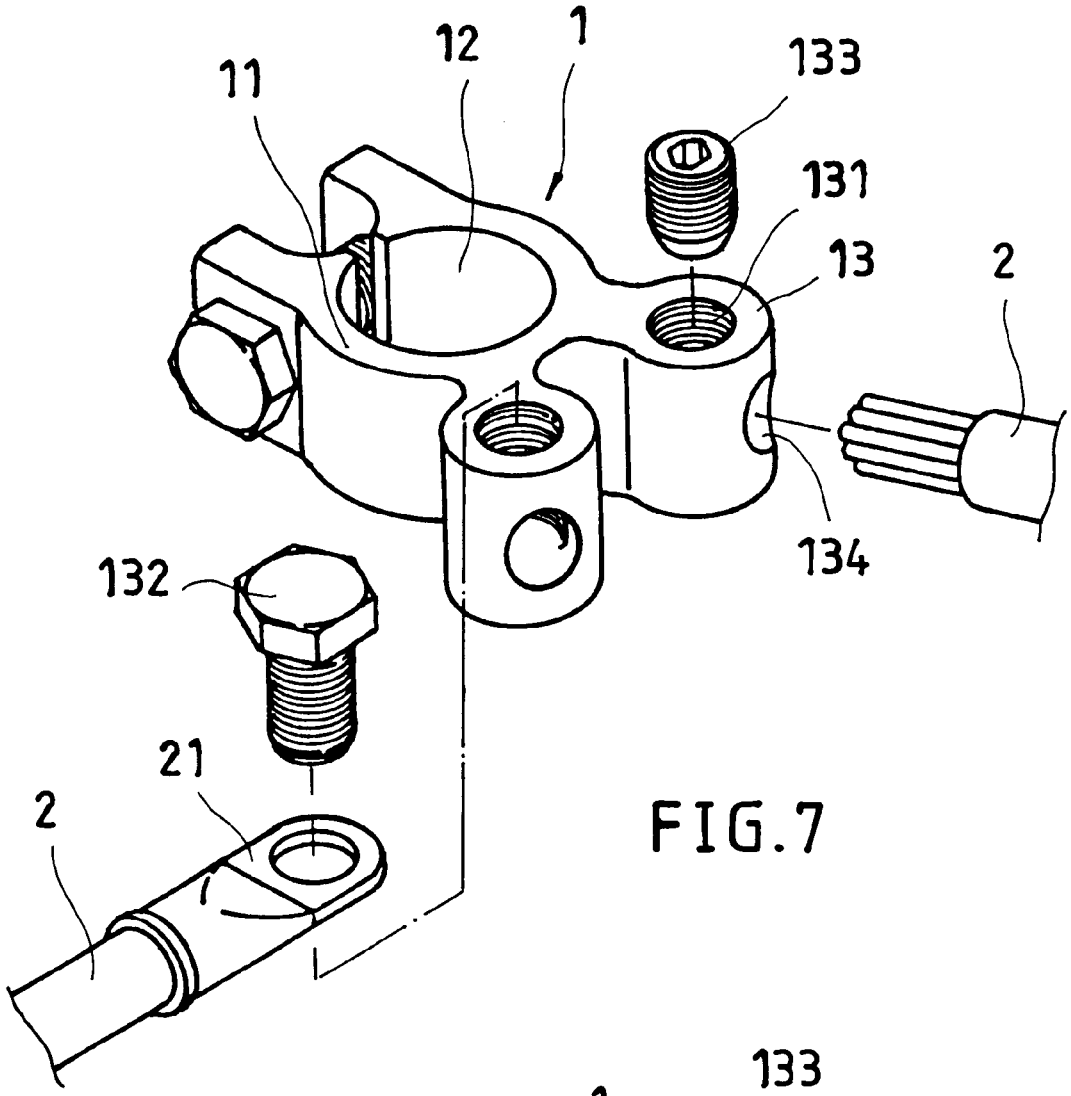
FIG. 7 illustrates still another alternate form of the battery terminal connector according to the present invention.
Figure 8:
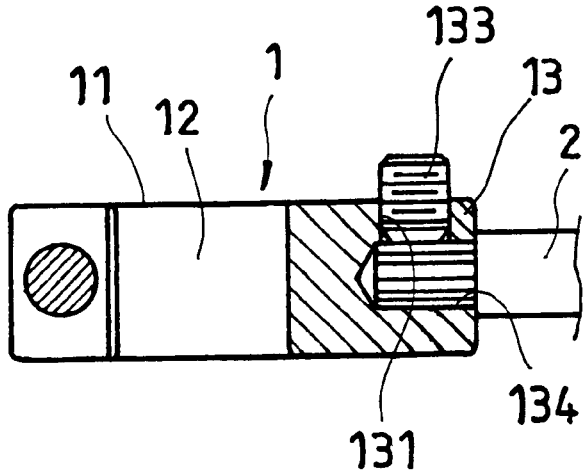
FIG. 8 is a sectional assembly view of the embodiment shown in FIG. 7.

FIGS. 7 and 8 show still another alternate form of the present invention. According to this alternate form, each wire distribution holder 13 comprises a vertically extended screw hole 131 and a horizontally extended wire hole 134 disposed in communication with the screw hole 131. The conductors of the corresponding electric wire 2 are directly inserted into the wire hole 134, and a holding down screw 133 is threaded into the screw hole 131 to hold down the conductors of the electric wire 2.

Figure 9:
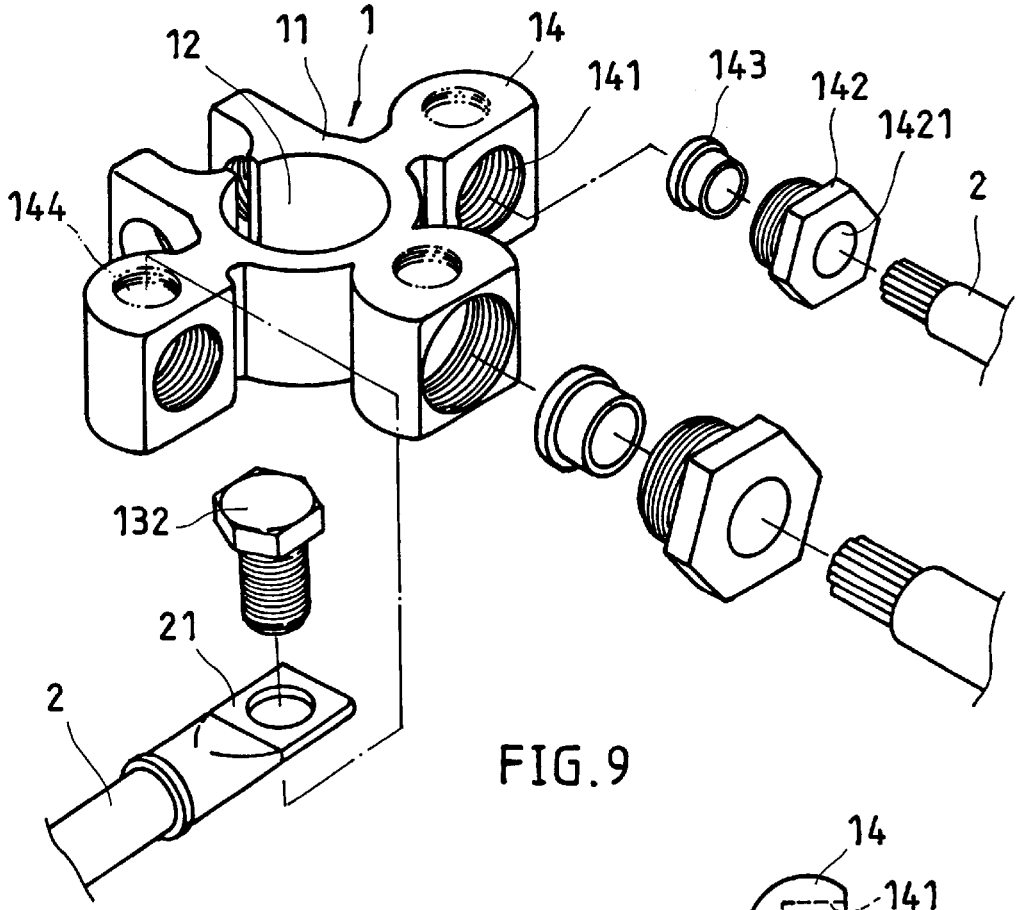
FIG. 9 illustrates still another alternate form of the battery terminal connector according to the present invention.
Figure 10:
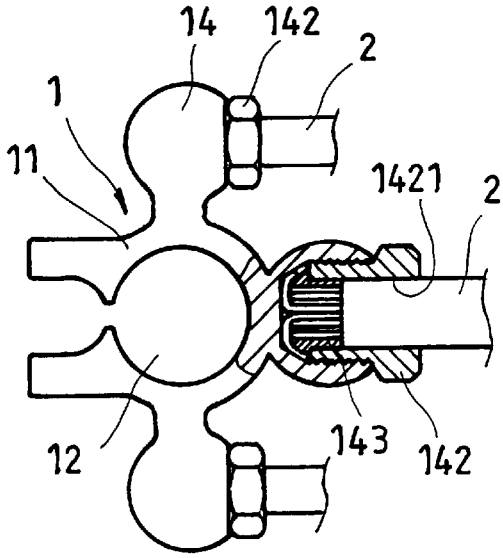
FIG. 10 is a top view in section showing the embodiment of FIG. 9 assembled.

FIGS. 9 and 10 show still another alternate form of the present invention. According to this alternate form, the battery terminal connector 1 comprises a metal mounting base 11, and a plurality of metal wire distribution holders 14 integral with the periphery of the mounting base 11. The structure of the mounting base 11 is same as the various aforesaid embodiments. Each wire distribution holder 14 comprises a vertical screw hole 144 and a horizontal screw hole 141 disposed in communication with the vertical screw hole 144. The user can selectively fasten the terminal 21 of an electric wire 2 to the vertical screw hole 144 by a screw bolt 132. Alternatively, the user can fasten an electric wire 2 to the horizontal screw hole 141 of one wire distribution holder 14 by a hollow screw bolt 142 and a tubular wire binder 143. During installation, the conductors of the electric wire 2 are inserted through the axial center through hole 1421 of the hollow screw bolt 142 and fastened to the tubular wire binder 143, and then the hollow screw bolt 142 is threaded into the horizontal screw hole 141 to fixedly secure the tubular wire binder 143 and the electric wire 2 to the respective wire distribution holder 14.

Figure 11:
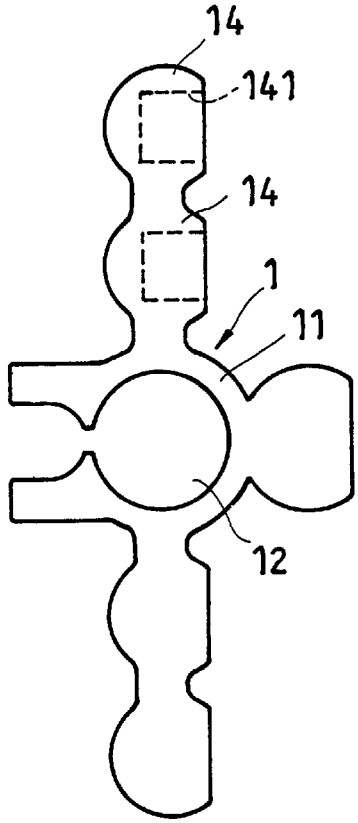
FIG. 11 is a top plain view of still another alternate form of the battery terminal connector according to the present invention.
Figure 12:
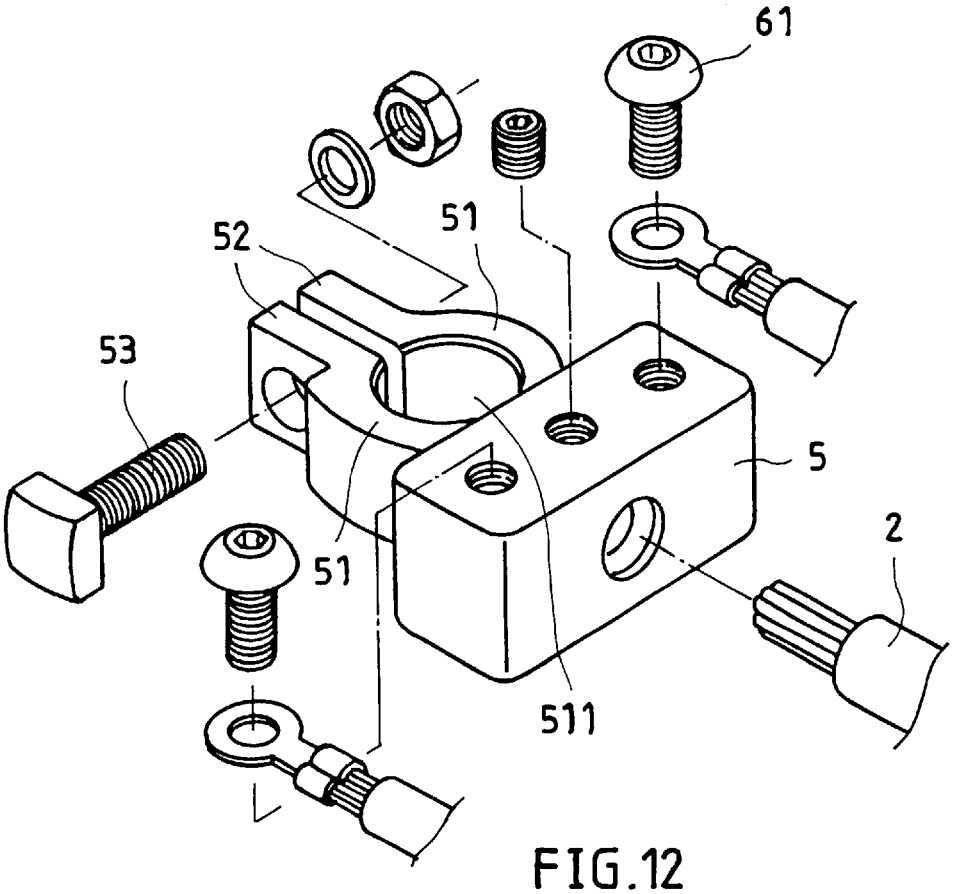
FIG.12 PRIOR ART
FIG. 12 illustrates a battery terminal connector according to the prior art.
Figure 13:
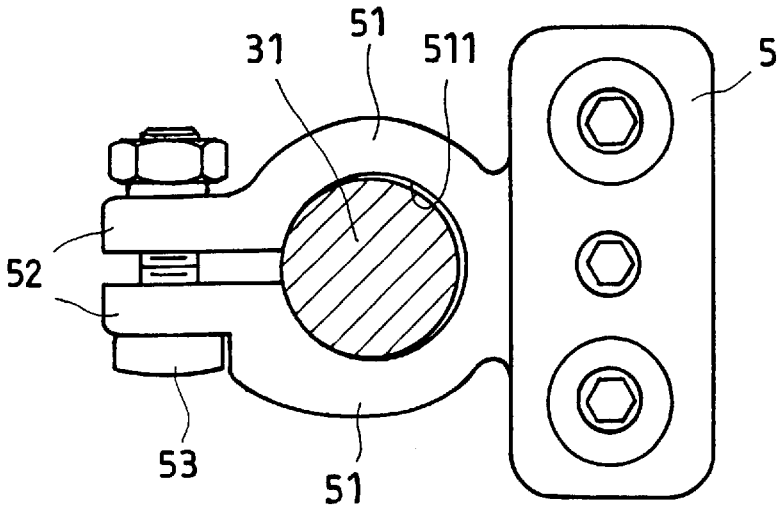
FIG.13 PRIOR ART
FIG. 13 is a sectional view showing the prior art battery terminal connector installed.

FIG. 11 shows still another alternate form of the present invention. This alternate form is similar to the embodiment as shown in FIGS. 9 and 10 with the exception of the number of horizontal screw holes 141 on each wire distribution holder 14.

It is to be understood that the drawings are designed for purposes of illustration only, and are not intended for use as a definition of the limits and scope of the invention disclosed.

What the invention claimed is:

1. A battery terminal connector comprising:

a) a metal mounting base including a first clamping arm and a second clamping arm arranged in parallel and defining a circular mounting hole for mounting on a terminal of a battery, said first clamping arm including a front extension portion having a transverse screw hole formed therein, said second clamping arm including a front extension portion having a transverse through hole formed therein, b) a screw bolt engaged through said transverse through hole of said second clamping arm and threaded to said transverse screw hole of said first clamping arm for connecting said first and said second clamping arms to said terminal of said battery, c) said metal mounting base including a periphery having at least one wire distribution holder radially extended therefrom, said at least one wire distribution holder including at least one horizontally extended screw hole, and d) at least one fastening device installed in said at least one horizontally extended screw hole of said at least one wire distribution holder to secure conductors of an electric wire, said at least one fastening device including:

i) a wire binder adapted to secure to the conductors of the electric wire, and ii) a hollow screw bolt threaded to said at least one horizontally extended screw hole of said at least one wire distribution holder and engaged with said wire binder for securing said wire binder and the conductors of the electric wire in place.

2. The battery terminal connector according to claim 1, wherein said at least one wire distribution holder includes at least one vertically extended screw hole formed therein and in communication with said at least one horizontally extended screw hole of said at least one wire distribution holder.

3. A battery terminal connector comprising:

a) a metal mounting base including a first clamping arm and a second clamping arm arranged in parallel and defining a circular mounting hole for mounting on a terminal of a battery, said first clamping arm including a front extension portion having a transverse screw hole formed therein, said second clamping arm including a front extension portion having a transverse through hole formed therein, b) a screw bolt engaged through said transverse through hole of said second clamping arm and threaded to said transverse screw hole of said first clamping arm for connecting said first and said second clamping arms to said terminal of said battery, c) said metal mounting base including a periphery having a plurality of wire distribution holders radially extended therefrom, said wire distribution holders each including at least one horizontally extended screw hole, and d) a plurality of fastening devices installed in said at least one horizontally extended screw holes of said wire distribution holders respectively to secure conductors of electric wires, said fastening devices each including:

i) a wire binder adapted to secure to the conductors of the electric wires, and ii) a hollow screw bolt threaded to said at least one horizontally extended screw hole of said wire distribution holders and engaged with said wire binder for securing said wire binder and the conductors of the electric wires in place.

4. The battery terminal connector according to claim 3, wherein said wire distribution holders each includes at least one vertically extended screw hole formed therein and in communication with said at least one horizontally extended screw hole thereof.

* * * * *